US010941734B2

(12) United States Patent
Watanabe et al.

(10) Patent No.: US 10,941,734 B2
(45) Date of Patent: Mar. 9, 2021

(54) ENGINE CONTROL APPARATUS

(71) Applicant: SUBARU CORPORATION, Tokyo (JP)

(72) Inventors: Tazuki Watanabe, Tokyo (JP); Taichiro Kitamura, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 83 days.

(21) Appl. No.: 16/208,851

(22) Filed: Dec. 4, 2018

(65) Prior Publication Data

US 2019/0301406 A1 Oct. 3, 2019

(30) Foreign Application Priority Data

Mar. 27, 2018 (JP) ..... JP2018-059311

(51) Int. Cl.
*F02D 41/22* (2006.01)
*F02M 26/49* (2016.01)
(Continued)

(52) U.S. Cl.
CPC ..... *F02M 26/49* (2016.02); *F02D 41/0007* (2013.01); *F02D 41/222* (2013.01);
(Continued)

(58) Field of Classification Search
CPC .... F02M 26/49; F02M 26/02; F02D 41/0007; F02D 41/222; F02D 2041/0017;
(Continued)

(56) References Cited

U.S. PATENT DOCUMENTS 5,309,887 A * 5/1994 Kondo ..... F02D 41/0055 123/568.16
2002/0007821 A1* 1/2002 Isobe ..... F02D 41/0055 123/480
(Continued)

FOREIGN PATENT DOCUMENTS

JP 2001-349231 A 12/2001
JP 2009-191701 A 8/2009
(Continued)

OTHER PUBLICATIONS

Japanese Office Action, dated Jul. 9, 2019, in Japanese Application No. 2018-059311 and English Translation thereof.

*Primary Examiner* — Matthew T Largi
(74) *Attorney, Agent, or Firm* — McGinn IP Law Group, PLLC

(57) ABSTRACT

An engine control apparatus includes first and second fuel injection amount calculators, a fuel injection controller, an EGR valve controller, and an EGR valve diagnosis unit. The first and second fuel injection amount calculators are configured to calculate first and second fuel injection amounts on the basis of a detected intake air amount and detected pressure in an intake pipe, respectively. The fuel injection controller is configured to control a fuel injection apparatus for an engine on the basis of a correction fuel injection amount that is a result of addition of the first and second fuel injection amounts respectively multiplied by first and second weight coefficients. When the fuel injection is restarted after diagnosis of the EGR valve carried out by the EGR valve diagnosis unit, the fuel injection controller increases the second weight coefficient, and thereafter gradually increases and reduces the first and second weight coefficients, respectively.

7 Claims, 3 Drawing Sheets

(51) Int. Cl.
*F02D 41/00* (2006.01)
*F02M 26/02* (2016.01)

(52) U.S. Cl.
CPC ..... *F02M 26/02* (2016.02); *F02D 2041/001* (2013.01); *F02D 2041/0017* (2013.01); *F02D 2041/223* (2013.01); *F02D 2041/224* (2013.01)

(58) Field of Classification Search
CPC ..... F02D 2041/224; F02D 2041/223; F02D 2041/001; F02D 37/02; F02D 41/32; F02D 41/182; F02D 41/123; F02D 41/126; F02D 41/0055; F02D 2200/0406; F02P 5/1504
See application file for complete search history.

(56) References Cited

U.S. PATENT DOCUMENTS

2003/0106367 A1* 6/2003 Osaki ..... F02D 41/0055 73/114.76
2005/0210970 A1* 9/2005 Terada ..... F02D 41/222 73/114.76
2007/0062499 A1* 3/2007 Miyasako ..... F02D 41/0055 123/568.16
2008/0202482 A1* 8/2008 Furuta ..... F02B 47/08 123/568.16
2010/0186726 A1 7/2010 Takagi
2010/0263627 A1* 10/2010 Whitney ..... F02M 26/49 123/399

FOREIGN PATENT DOCUMENTS

JP 2010-096003 A 4/2010
JP 5077281 B2 11/2012

* cited by examiner

ENGINE CONTROL APPARATUS

CROSS-REFERENCE TO RELATED APPLICATIONS

The present application claims priority from Japanese Patent Application No. 2018-059311 filed on Mar. 27, 2018, the entire contents of which are hereby incorporated by reference.

BACKGROUND

The technology relates to an engine control apparatus that are each configured to control a fuel injection amount and carry out diagnosis of an EGR apparatus.

For example, it is known that exhaust gas recirculation (EGR) is carried out in an engine for a vehicle such as an automobile. The EGR causes part of exhaust gas to flow back into an intake pipe.

The EGR involves mixing of the exhaust gas that is substantially inactive gas with air for combustion that is to be introduced into the engine. The air for combustion may be, for example, fresh air. Herewith, by making an opening degree of a throttle valve greater during a partial load, it is possible to reduce a pumping loss, and it is possible to improve resistance to knocking. For this reason, it is possible to advance ignition timing, and it is possible to improve fuel economy by improving thermal efficiency.

Further, by lowering a combustion temperature, it is possible to reduce NOx in the exhaust gas, and it is also possible to suppress a cooling loss.

An EGR apparatus includes an EGR flow passage and an EGR valve provided on the EGR flow passage. The exhaust gas is introduced into an intake apparatus through the EGR flow passage. The EGR valve is a regulating valve configured to control a flow rate of the exhaust gas, i.e., EGR gas.

In such an EGR valve, failure such as fixation in the valve may occur, or a flow rate of the EGR gas as a control target cannot be obtained due to aging degradation such as accumulation of deposit. In a case where such a situation occurs, a bad influence on fuel economy and/or performance to process the exhaust gas is concerned. For this reason, a controller for an engine of a vehicle or an engine control apparatus typically carries out diagnosis of the EGR apparatus or the EGR valve.

The diagnosis of the EGR apparatus is carried out when a vehicle is in a coast traveling and fuel cut is carried out, for example. In this diagnosis, the controller detects variation in pressure in an intake pipe while increasing an opening degree of the EGR valve in a stepwise manner.

For example, in a case where the pressure in the intake pipe does not indicate a predetermined change, i.e., where the EGR apparatus has no sensitivity, regardless of a change in an instruction value for the opening degree of the EGR valve, it is determined that failure occurs in the EGR apparatus.

As an art regarding the diagnosis of the EGR apparatus or the EGR valve described above and a control upon restart of fuel injection after the diagnosis, there is cited Japanese Patent (JP-B) No. 5,077,281, for example. JP-B No. 5,077,281 describes that a state of an EGR mechanism is estimated on the basis of variation in intake pressure at a time when an opening degree of an EGR valve during fuel cut of an internal-combustion engine is varied to an opening side compared with that in a usual state. Further, JP-B No. 5,077,281 also describes that, in a case where fuel cut is stopped in a state where the opening degree of the EGR valve is greater than that in the usual state, ignition timing is largely retarded with respect to that in the usual state and a fuel injection amount is corrected so as to be increased.

SUMMARY

An aspect of the technology provides an engine control apparatus that includes a first fuel injection amount calculator, a second fuel injection amount calculator, a fuel injection controller, an EGR valve controller, and an EGR valve diagnosis unit. The first fuel injection amount calculator is configured to calculate a first fuel injection amount on the basis of an intake air amount detected by an air flow meter. The second fuel injection amount calculator is configured to calculate a second fuel injection amount on the basis of pressure in an intake pipe detected by an intake pressure sensor. The fuel injection controller is configured to control a fuel injection apparatus for an engine on the basis of a correction fuel injection amount. The correction fuel injection amount is a result of addition of the first fuel injection amount multiplied by a first weight coefficient and the second fuel injection amount multiplied by a second weight coefficient. The EGR valve controller is configured to control an EGR valve. The EGR valve is configured to open and close an EGR flow passage through which exhaust gas from the engine is introduced to the intake pipe. The EGR valve diagnosis unit is configured to carry out diagnosis of the EGR valve on the basis of the pressure in the intake pipe at a time when an opening degree of the EGR valve is varied in a state where fuel injection is stopped. When the fuel injection is restarted after the diagnosis of the EGR valve is carried out by the EGR valve diagnosis unit, the fuel injection controller increases the second weight coefficient, and after the increasing of the second weight coefficient, gradually varies the first and second weight coefficients to cause the second weight coefficient to be reduced and the first weight coefficient to be increased.

An aspect of the technology provides an engine control apparatus that includes an intake pressure sensor, an EGR valve controller, an EGR valve diagnosis unit, and an ignition controller. The intake pressure sensor is configured to detect pressure in an intake pipe of an engine. The EGR valve controller is configured to control an EGR valve. The EGR valve is configured to open and close an EGR flow passage through which exhaust gas from the engine is introduced to the intake pipe. The EGR valve diagnosis unit is configured to carry out diagnosis of the EGR valve on the basis of the pressure in the intake pipe at a time when an opening degree of the EGR valve is varied in a state where fuel injection is stopped. The ignition controller is configured to set ignition timing for the engine. When the fuel injection is restarted after the diagnosis of the EGR valve is carried out by the EGR valve diagnosis unit, the ignition controller delays the ignition timing by a retard amount with respect to ignition timing at a usual time. The retard amount is set on the basis of the pressure in the intake pipe detected by the intake pressure sensor.

An aspect of the technology provides an engine control apparatus that includes circuitry configured to control an engine and an EGR apparatus. The circuitry is configured to calculate a first fuel injection amount on a basis of an intake air amount detected by an air flow meter, The circuitry is configured to calculate a second fuel injection amount on a basis of pressure in an intake pipe detected by an intake pressure sensor. The circuitry is configured to control a fuel injection apparatus for the engine on a basis of a correction fuel injection amount, the correction fuel injection amount being a result of addition of the first fuel injection amount multiplied by a first weight coefficient and the second fuel injection amount multiplied by a second weight coefficient. The circuitry is configured to control an EGR valve configured to open and close an EGR flow passage, in the EGR apparatus, through which exhaust gas from the engine is introduced to the intake pipe. The circuitry is configured to carry out diagnosis of the EGR valve on a basis of the pressure in the intake pipe at a time when an opening degree of the EGR valve is varied in a state where fuel injection is stopped The circuitry is configured to increase, when the fuel injection is restarted after the diagnosis of the EGR valve is carried out, the second weight coefficient, and after the increasing of the second weight coefficient, gradually vary the first and second weight coefficients to cause the second weight coefficient vary to be reduced and the first weight coefficient to be increased.

DETAILED DESCRIPTION

Figure 1:
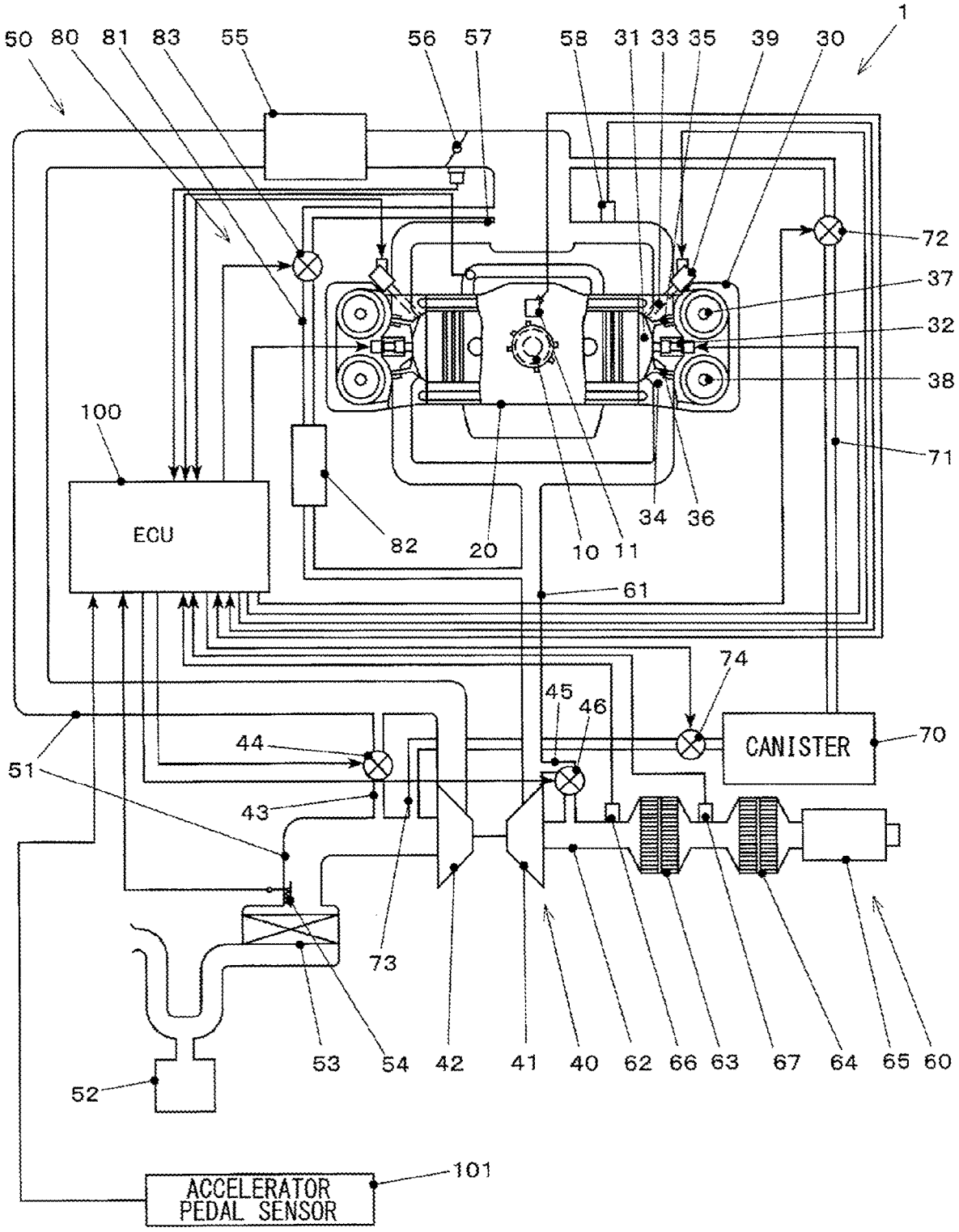
FIG. 1 is a diagram schematically illustrating an example of a configuration of an engine to which an engine control apparatus according to one implementation of the technology is applied.

Hereinafter, an engine control apparatus and an engine control system according to one implementation of the technology will be described.

In an engine control apparatus configured to carry out diagnosis of an EGR apparatus or an EGR valve and a control upon restart of fuel injection after the diagnosis, a throttle valve is substantially fully closed during the diagnosis of the EGR apparatus. For this reason, an intake air amount detected by an air flow meter, e.g., a fresh air flow rate, is small. However, an opening degree of the EGR valve is greater than that during a usual state. Therefore, air flows into an intake pipe from an exhaust system, and intake pressure in an intake manifold thus becomes relatively greater.

In a case where a fuel injection amount is set on the basis of the intake air amount detected by the air flow meter upon the restart of the fuel injection in such a state, an air-fuel ratio becomes leaner, which may possibly lead to misfire.

Further, in a case where the fuel injection amount is increased to the extent that no lean misfire occurs and combustion can be maintained, excessive torque is generated to cause shock to occur on a vehicle body. This impairs drivability, e.g., ease of driving, and comfort.

To address such problems, JP-B No. 5,077,281 described above discloses a technique in which the fuel injection amount is increased in accordance with the opening degree of the EGR valve and ignition timing is retarded when the fuel injection is restarted after the diagnosis of the EGR apparatus has been carried out in a fuel cut state. This makes it possible to prevent the lean misfire and suppress the torque.

However, for example, even though opening degrees of EGR valves are the same, pressure in an intake pipe, corresponding to an air amount, may vary depending upon an individual difference among the EGR valves, accumulation of deposit, etc. For this reason, the air amount introduced into a combustion chamber upon the restart of the fuel injection does not become constant. For that reason, even though fuel increase correction and/or ignition timing retard correction set in advance are carried out, it may lead to insufficient correct or excessive correction. There may be concern that sudden variation in torque cannot be suppressed adequately.

Therefore, it is desirable to provide an engine control apparatus and an engine control system each capable of suppressing sudden variation in torque at a time when fuel injection is restarted after diagnosis of an EGR apparatus is terminated.

In the following, some implementations of the technology are described with reference to the accompanying drawings. Note that the following description is directed to illustrative examples of the disclosure and not to be construed as limiting to the technology. In each of the drawings referred to in the following description, elements have different scales in order to illustrate the respective elements with sizes recognizable in the drawings. Therefore, factors including, without limitation, the number of each of the elements, the shape of each of the elements, a size of each of the elements, a ratio between the elements, and relative positional relationship between the elements are illustrative only and not to be construed as limiting to the technology. Further, elements in the following example implementations which are not recited in a most-generic independent claim of the disclosure are optional and may be provided on an as-needed basis. Throughout the present specification and the drawings, elements having substantially the same function and configuration are denoted with the same numerals to avoid any redundant description.

FIG. 1 schematically illustrates an example of a configuration of an engine control system provided with an engine control apparatus according to an example implementation of the technology.

The engine control apparatus according to an example implementation may be provided in a flat-four, gasoline direct-injection and turbocharging engine, for example. Such an engine may be mounted on a vehicle such as an automobile as a power source for traveling. Non-limiting examples of such a vehicle may include a passenger car.

The engine control system may be configured to include an engine 1, an EGR apparatus 80, and an engine control unit 100. The engine control unit 100 is hereinafter referred to also as "ECU 100". The ECU 100 may control the whole engine 1 and the EGR apparatus 80. In an example implementation, the ECU 100 may serve as an engine control apparatus.

The engine 1 may include a crank shaft 10, a cylinder block 20, a cylinder head 30, a turbocharger 40, an intake system 50, an exhaust system 60, a canister 70, etc.

The crank shaft 10 may be an axis of rotation that becomes an output shaft of the engine 1.

An unillustrated power transmission system such as a transmission or a gearbox may be coupled to one end portion of the crank shaft 10.

A piston may be coupled to the crank shaft 10 via an unillustrated coupling rod.

A crank angle sensor 11 that detects an angular position of the crank shaft 10 may be provided at an end portion of the crank shaft 10.

An output of the crank angle sensor 11 may be transmitted to the ECU 100.

The cylinder block 20 may be configured as a two-divided structure so as to put the crank shaft 10 between the two portions from right and left directions in a case where the crank shaft 10 is vertically mounted on a vehicle body.

A crankcase unit may be provided in a middle portion of the cylinder block 20. The crankcase unit may house the crank shaft 10, and have a main bearing that rotatably supports the crank shaft 10.

Unillustrated pistons may be inserted inside respective right and left banks of the cylinder block 20. The right and left banks may be arranged on right and left side of the crankcase unit so as to put the crankcase unit therebetween. Two cylinders that reciprocate in each bank may be formed in the respective right and left banks in a case of four cylinders, for example.

The cylinder heads 30 may be provided at respective end portions, i.e., respective right and left end portions, each opposite to side of the crank shaft 10 of the cylinder block 20.

Each of the cylinder heads 30 may include a combustion chamber 31, a spark plug 32, an intake port 33, an exhaust port 34, an intake valve 35, an exhaust valve 36, an intake camshaft 37, an exhaust camshaft 38, an injector 39, etc.

The combustion chamber 31 may be formed into a pent roof shape by making concave a portion facing a crest place of the piston of the cylinder head 30, for example.

The spark plug 32 may be provided in the middle of the combustion chamber 31 to generate a spark in response to an ignition signal from the ECU 100, thereby igniting fuel-air mixture.

The intake port 33 may serve as a port for intake air, through which air for combustion, e.g., fresh air, is introduced into the combustion chamber 31.

The exhaust port 34 may serve as a port for exhaust gas, through which a burned gas, i.e., an exhaust gas, is discharged from the combustion chamber 31.

The intake valve 35 and the exhaust valve 36 may respectively open and close the intake port 33 and the exhaust port 34 at predetermined valve timing.

Two intake valves 35 and two exhaust valves 36 may be provided for each cylinder, for example.

The intake valve 35 and the exhaust valve 36 may be opened or closed by the intake camshaft 37 and the exhaust camshaft 38, respectively. The intake camshaft 37 and the exhaust camshaft 38 may rotate so as to synchronize with each other at half of a rotation number of the crank shaft 10.

An unillustrated valve timing variable mechanism may be provided in a cam sprocket of each of the intake camshaft 37 and the exhaust camshaft 38. The valve timing variable mechanism may vary a valve opening time and a valve closing time of each valve by advancing or retarding a phase of the corresponding camshaft.

The injector 39 may serve as a direct injection injector. Pressurized fuel, e.g., gasoline, may be supplied from an unillustrated high-pressure fuel pump to the injector 39. The injector 39 may inject fuel into the combustion chamber 31 in response to a valve opening signal issued by the ECU 100 to form the fuel-air mixture.

The turbocharger 40 may serve as a supercharger. The turbocharger 40 may utilize energy possessed by the exhaust gas from the engine 1 to compress and supercharge the air for combustion, e.g., fresh air.

The turbocharger 40 may include a turbine 41, a compressor 42, an air bypass flow passage 43, an air bypass valve 44, a waste gate flow passage 45, the waste gate valve 46, etc.

The turbine 41 may be rotatively driven by the exhaust gas from the engine 1.

The compressor 42 may be installed coaxially with the turbine 41. The compressor 42 may be rotatively driven by the turbine 41 to compress the air for combustion, e.g., fresh air.

The air bypass flow passage 43 may extract part of air from the downstream side of the compressor 42 to cause the extracted air to flow back to the upstream side of the compressor 42.

The air bypass valve 44 may be provided on the air bypass flow passage 43. The air bypass valve 44 may switch the state of the air bypass flow passage 43 between two stages including a closed state and an open state in response to an instruction from the ECU 100. The air bypass flow passage 43 may be substantially closed in the closed state. The air bypass flow passage 43 may allow air to pass therethrough in the open state.

The air bypass valve 44 may serve as a motor-operated valve having a valve element. The air bypass valve 44 may be driven by an electrical actuator so as to be opened or closed.

For example, in a case where a throttle valve 56 which will be described later is closed rapidly, the air bypass valve 44 may become an open state, for example, in order to prevent surging of the turbocharger 40 or to protect a blade. This may cause the air in an intake pipe downstream from the compressor 42 to flow back to the upstream side of the compressor 42 to reduce excessive pressure.

Further, the air bypass valve 44 may be set to the open state during supercharging to increase a flow rate of a purge gas from the canister 70 during the supercharging. This causes a negative pressure at an inlet of the compressor 42 to be greater.

With the aim of, for example, a boost pressure control or temperature rising of a catalyst, the waste gate flow passage 45 may extract part of the exhaust gas from the upstream side of the turbine 41 to cause the extracted exhaust gas to be bypassed to the downstream of the turbine 41.

The waste gate flow passage 45 may be formed integrally with a housing of the turbine 41.

The waste gate valve 46 may be provided on the waste gate flow passage 45. The waste gate valve 46 may include a valve element that opens or closes the waste gate flow passage 45. The waste gate valve 46 may be configured to control a flow rate of the exhaust gas passing through the waste gate flow passage 45.

The waste gate valve 46 may serve as a motor-operated waste gate valve having an electrical actuator. The electrical actuator may drive the valve element to open or close in response to an instruction from the ECU 100.

A state of the waste gate valve 46 can be switched between a fully-open state and a fully-closed state. The waste gate valve 46 can also be set to any opening degree between the fully-open state and the fully-closed state.

The intake system 50 may introduce air into the intake port 33.

The intake system 50 may include an intake duct 51, a chamber 52, an air cleaner 53, an air flow meter 54, an intercooler 55, the throttle valve 56, an intake manifold 57, an intake pressure sensor 58, etc.

The intake duct 51 may serve as a flow passage through which outside air is introduced into the intake port 33.

The chamber 52 may serve as a space that is provided so as to communicate with the vicinity of an inlet of the intake duct 51.

The air cleaner 53 may be provided downstream of a communication part with the chamber 52 in the intake duct 51. The air cleaner 53 may filter air flowing into the intake duct 51 from outside air to remove dust, etc.

The air flow meter 54 may be provided in the vicinity of an outlet of the air cleaner 53. The air flow meter 54 may measure or detect an intake air amount newly introduced into the intake duct 51, that is, a fresh air flow rate.

An output of the air flow meter 54 may be transmitted to the ECU 100.

The compressor 42 of the turbocharger 40 may be provided downstream of the air flow meter 54.

The intercooler 55 may be provided downstream of the compressor 42 in the intake duct 51, for example. The intercooler 55 may serve as a heat exchanger that cools air compressed and having a high temperature by means of, for example, heat exchange with traveling wind.

The throttle valve 56 may be provided downstream of the intercooler 55 in the intake duct 51. The throttle valve 56 may serve as a butterfly valve to control an output of the engine 1 by adjusting a flow rate of the air.

The throttle valve 56 may be driven by an unillustrated throttle actuator so as to be opened or closed in response to, for example, an accelerator pedal operation by a driver of the vehicle.

Further, a throttle sensor configured to detect an opening degree of the throttle valve 56 may be provided to the throttle valve 56. An output of the throttle sensor may be transmitted to the ECU 100.

The intake manifold 57 may serve as an intake pipe provided downstream of the throttle valve 56, and may be a branched pipe to distribute air to the intake ports 33 of the respective cylinders.

The intake pressure sensor 58 may detect pressure of air in the intake manifold 57, i.e., intake pressure.

An output of the intake pressure sensor 58 may be transmitted to the ECU 100.

The exhaust system 60 may discharge exhaust gas discharged from the exhaust port 34 to the outside.

The exhaust system 60 may include an exhaust manifold 61, an exhaust pipe 62, a front catalyst 63, a rear catalyst 64, an exhaust silencer 65, an air-fuel ratio sensor 66, a rear $O_2$ sensor 67, etc.

The exhaust manifold 61 may serve as a collecting pipe. The exhaust manifold 61 may collect the exhaust gas from the exhaust port 34 of each cylinder.

The turbine 41 of the turbocharger 40 may be disposed downstream of the exhaust manifold 61.

The exhaust pipe 62 may serve as a pipe to discharge the exhaust gas outputted from the turbine 41 to the outside.

The front catalyst 63 and the rear catalyst 64 may be provided in an intermediate portion of the exhaust pipe 62 in this order. Each of the front catalyst 63 and the rear catalyst 64 may include a three-way catalyst to purify HC, NOx, CO, etc. in the exhaust gas.

The front catalyst 63 may be provided adjacent to an outlet of the turbine 41. The rear catalyst 64 may be provided on side of an outlet of the front catalyst 63.

The exhaust silencer 65 may be provided in the vicinity of an outlet of the exhaust pipe 62. The exhaust silencer 65 may reduce acoustic energy of exhaust gas.

The air-fuel ratio sensor 66 may be provided between an outlet of the turbine 41 and an inlet of the front catalyst 63.

The rear $O_2$ sensor 67 may be provided between the outlet of the front catalyst 63 and an inlet of the rear catalyst 64.

Both the air-fuel ratio sensor 66 and the rear $O_2$ sensor 67 may generate output voltage in accordance with oxygen concentration in the exhaust gas. The air-fuel ratio sensor 66 and the rear $O_2$ sensor 67 may detect an amount of oxygen in the exhaust gas by generating the output voltage in accordance with oxygen concentration of the exhaust gas.

The air-fuel ratio sensor 66 may serve as a linearly output sensor. The air-fuel ratio sensor 66 can detect the oxygen concentration with respect to a wider range of air-fuel ratio than the rear $O_2$ sensor 67.

Outputs of the air-fuel ratio sensor 66 and the rear $O_2$ sensor 67 may both be transmitted to the ECU 100.

A fuel evaporative gas, i.e., evaporant, generated in an unillustrated fuel tank may be introduced into and temporarily occluded in a canister 70. The canister 70 may serve as a charcoal canister, for example. Gasoline used as fuel of the engine 1 may be stored in the fuel tank.

The canister 70 may house activated carbon in an unillustrated canister case. The activated carbon can adsorb the fuel evaporative gas temporarily. The canister case may be a housing including resin.

The canister 70 may include a purge line 71 and a purge control valve (PCV) 72 mainly used during non-supercharging, a purge line 73 and a purge control valve (PCV) 74 mainly used during the supercharging, etc.

One end portion of the purge line 71 may be coupled to the canister 70 and the other end portion of the purge line 71 may be coupled to the intake manifold 57. The purge line 71 may serve as a flow passage to cause the insides of the canister 70 and the intake manifold 57 communicate with each other.

The purge line 71 may introduce the purge gas into the intake manifold 57 during the non-supercharging in which the inside of the intake manifold 57 becomes negative pressure. The purge gas may include the fuel evaporative gas discharged from the canister 70.

The PCV 72 may serve as a duty control solenoid valve provided in the middle of the purge line 71.

The PCV 72 can switch between an open state and a closed state in response to an instruction from the ECU 100. An opening degree of the PCV 72 in the open state can also set.

One end portion of the purge line 73 may be coupled to the canister 70 and the other end portion of the purge line 73 may be coupled to a region, in the intake duct 51, adjacent to the inlet of the compressor 42. The purge line 73 may serve as a flow passage to cause the canister 70 and the foregoing region to communicate with each other.

The purge line 73 may introduce the purge gas into the intake duct 51 on upstream side of the compressor 42 during the supercharging. Since the inside of the intake manifold 57 becomes positive pressure during the supercharging, it becomes more difficult to introduce the purge gas via the purge line 71.

The PCV 74 may serve as a solenoid valve provided in the middle of the purge line 73.

The PCV 74 can switch between an open state and a closed state in response to an instruction from the ECU 100.

The EGR apparatus 80 may extract part of the exhaust gas from the exhaust manifold 61 as the EGR gas. The EGR apparatus 80 may recirculate the exhaust gas to be introduced into the intake manifold 57. In other words, the EGR apparatus 80 may perform EGR.

The EGR apparatus 80 may include an EGR flow passage 81, an EGR cooler 82, an EGR valve 83, etc.

The EGR flow passage 81 may serve as a pipe passage to introduce the exhaust gas, i.e., EGR gas, to the intake manifold 57 from the exhaust manifold 61. In place of such a configuration, the EGR apparatus 80 may directly extract the exhaust gas from the exhaust port 34 of the cylinder head 30.

The EGR cooler 82 may be provided in the middle of the EGR flow passage 81. The EGR cooler 82 may cool the EGR gas flowing in the EGR flow passage 81 by means of heat exchange with cooling water for the engine 1.

The EGR valve 83 may be provided downstream of the EGR cooler 82 in the EGR flow passage 81. The EGR valve 83 may be a regulating valve to adjust a flow rate of the EGR gas passing through the inside of the EGR flow passage 81.

The EGR valve 83 may include a valve element to be driven by an electrical actuator such as a solenoid. The ECU 100 may feedback-control an opening degree of the EGR valve 83 so that an actual EGR rate becomes closer to a predetermined target EGR rate. The actual EGR rate may be calculated by an expression of (EGR gas flow rate)/(fresh air flow rate).

The ECU 100 may perform a general control of the engine 1 and its auxiliary devices.

The ECU 100 may include an information processor such as a central processing unit (CPU), a storage such as a random-access memory (RAM) or a read-only memory (ROM), an input/output interface, a bus coupling them to each other.

Further, an accelerator pedal sensor 101 may be provided in the vehicle on which the engine 1 is mounted. The accelerator pedal sensor 101 may detect a pressing amount of an unillustrated accelerator pedal by the driver. An output of the accelerator pedal sensor 101 may be transmitted to the ECU 100.

The ECU 100 may set driver request torque on the basis of, for example, the output of the accelerator pedal sensor 101.

The ECU 100 may control, for example, the opening degree of the throttle valve 56, a boost pressure, a fuel injection amount, fuel injection timing, ignition timing, valve timing, an EGR valve opening degree, etc., so that torque actually generated by the engine 1 becomes closer to the driver request torque set as described above.

The ECU 100 may serve as a first fuel injection amount calculator that calculates a first fuel injection amount in accordance with the intake air amount detected by the air flow meter 54. The ECU 100 may also serve as a second fuel injection amount calculator that calculates a second fuel injection amount on the basis of internal pressure of the intake manifold 57 detected by the intake pressure sensor 58. Further, the ECU 100 may also serve as a fuel injection controller to control a fuel injection apparatus of the engine 1 on the basis of a correction fuel injection amount.

The correction fuel injection amount may be obtained by respectively multiplying the first and second fuel injection amounts by first and second weight coefficients and adding the multiplied first and second fuel injection amounts. The ECU 100 may carry out a fuel injection control by using the correction fuel injection amount as a basic injection quantity. The fuel injection apparatus may include the intake port 33, the exhaust port 34, the intake camshaft 37, the exhaust camshaft 38, the injector 39, etc.

Moreover, the ECU 100 may also serve as an ignition controller to set ignition timing of the engine 1, that is, ignition timing of the spark plug 32.

The ECU 100 may also serve as an EGR valve controller during usual driving, e.g., when diagnosis is not carried out. The EGR valve controller may set a target EGR rate in accordance with the intake air amount detected by the air flow meter 54, and control the opening degree of the EGR valve 83 so that a ratio of the flow rate of the EGR gas to the intake air amount, that is, an actual EGR rate, becomes closer to the target EGR rate.

Further, the ECU 100 may serve as an EGR valve diagnosis unit that carry outs diagnosis of the EGR valve 83 on the basis of pressure of the intake pipe at a time when the opening degree of the EGR valve 83 is varied in a state where the fuel injection is stopped.

The ECU 100 may control the fuel injection amount during the usual driving so that an air-fuel ratio in the cylinder detected by the air-fuel ratio sensor 66 substantially becomes stoichiometric, i.e., falls within an active range, of the three-way catalyst provided in each of the front catalyst 63 and the rear catalyst 64, for example, except for the case where increase correction, e.g., enrichment of air-fuel ratio, is carried out, for example, immediately after start of the engine 1 or upon a high load.

The ECU 100 may set a basic injection quantity, i.e., the first fuel injection amount, on the basis of the intake air amount detected by the air flow meter 54 during the usual driving, that is, in a case where diagnosis of the EGR valve 83 is not carried out. The ECU 100 may also carry out a feedback control for the air-fuel ratio to correct the fuel injection amount on the basis of the output of the air-fuel ratio sensor 66 so that an actual air-fuel ratio falls within the active range of the three-way catalyst.

Thus, by controlling the fuel injection amount on the basis of an intake air amount that is to be newly introduced into the intake system 50, it is possible to carry out a suitable air-fuel ratio control even in a case where a large amount of EGR gas is introduced into the intake pipe.

Further, the ECU 100 may carry out diagnosis of the EGR valve 83. When the fuel injection is restarted after the diagnosis is completed or interrupted, the ECU 100 may set a basic injection quantity, i.e., the second fuel injection amount, on the basis of the pressure in the intake pipe, i.e., the internal pressure of the intake manifold 57, detected by the intake pressure sensor 58.

For example, the second fuel injection amount can be calculated on the basis of an air amount calculated by the following Expression 1.

$$\text{(Air amount)}=\text{(Volumetric efficiency)}\times\text{(Intake manifold internal pressure)}\times\text{(Constant)}/\text{(Intake air temperature)} \quad \text{(Expression 1)}$$

Note that the intake air temperature may be detected by an unillustrated intake air temperature sensor.

Upon the restart of the fuel injection, the ECU 100 may first start fuel injection by using the second fuel injection amount as the basic injection quantity. Thereafter, the ECU 100 may gradually vary the first and second weight coefficients in conjunction with the internal pressure of the intake manifold 57 so that the second weight coefficient corresponding to the second fuel injection amount is reduced and the first weight coefficient corresponding to the first fuel injection amount is increased. The ECU 100 may finally shift to a control during the usual driving by using only the first fuel injection amount as the basic injection quantity.

This point will be described in detail with reference to a flowchart of FIG. 2.

Figure 2:
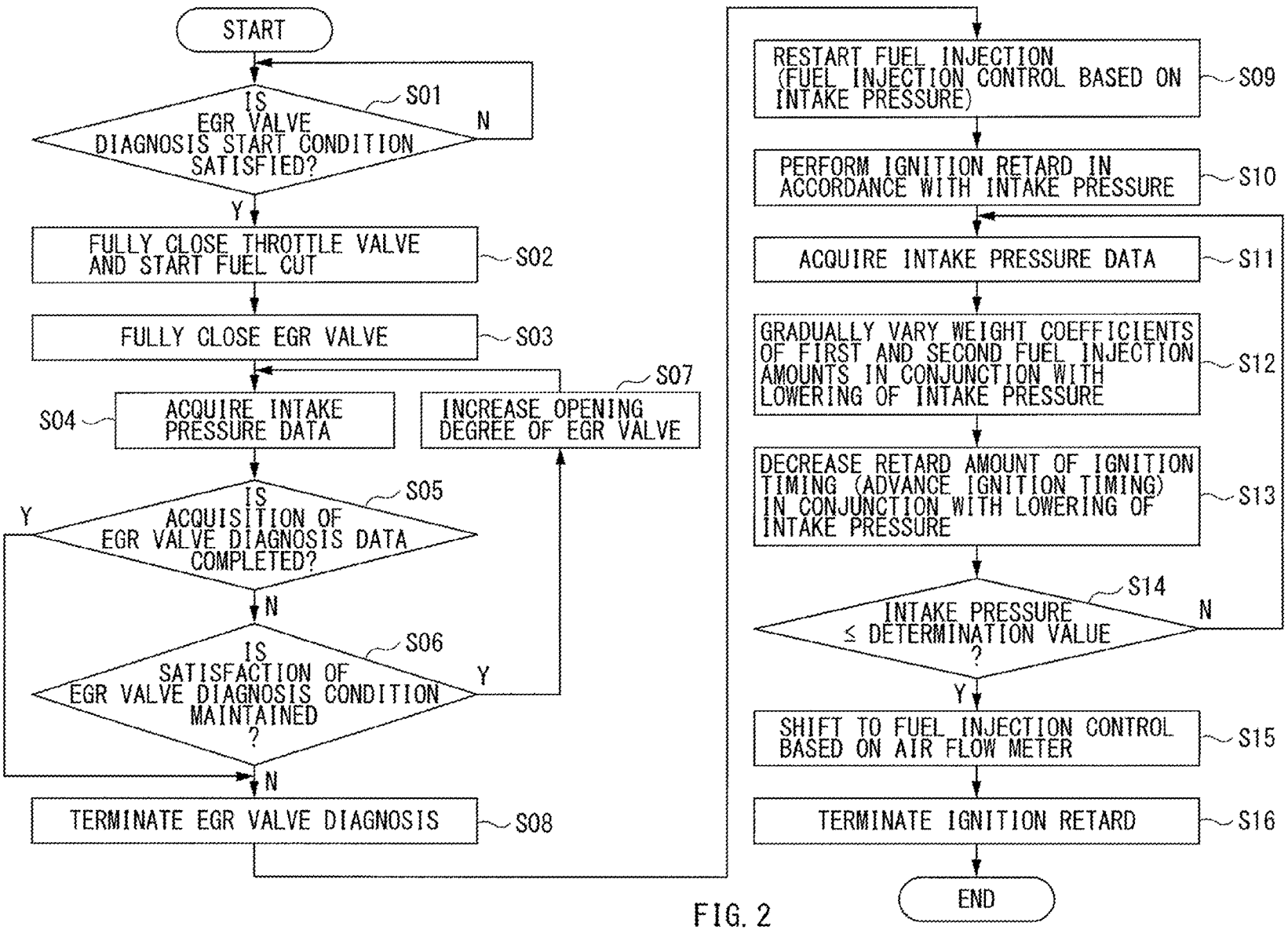
FIG. 2 is a flowchart illustrating an example of EGR valve diagnosis and a control upon restart of fuel injection thereafter both carried out by the engine control apparatus illustrated in FIG. 1.

FIG. 2 is a flowchart illustrating EGR valve diagnosis and a control upon restart of the fuel injection thereafter carried out by the engine control apparatus illustrated in FIG. 1.

Each step will be described below in turn.

[Step S01: Determination as to Whether EGR Valve Diagnosis Start Condition is Satisfied]

The ECU 100 may determine whether a current driving state of the engine 1 satisfies a diagnosis start condition for the EGR apparatus or the EGR valve 83. The diagnosis start condition may be set in advance.

As the diagnosis start condition, for example, there may be cited a condition in which driver request torque is substantially zero, that is, the accelerator pedal is in an off state, predetermined fuel cut condition is satisfied, and a predetermined time or longer elapses from previous diagnosis of the EGR apparatus.

In a case where it is determined that the diagnosis start condition is satisfied, the processing flow may proceed to Step S02. In a case where it is determined that the diagnosis start condition is not satisfied, the ECU 100 may repeat the process in Step S01 until the diagnosis start condition is satisfied.

[Step S02: Full Closing of Throttle and Start of Fuel Cut]

The ECU 100 may substantially fully close the throttle valve 56, and start fuel cut in which fuel injection from the injector 39 is stopped.

This may cause the engine 1 to be in a predetermined state. In the predetermined state, the crank shaft 10 of the engine 1 may be rotated by torque inputted in accordance with rotation of unillustrated wheels during coast traveling of the vehicle, but the fuel injection and combustion of fuel is not performed.

The processing flow then proceeds to Step S03.

[Step S03: Full Closing of EGR Valve]

The ECU 100 may provide the EGR valve 83 with an instruction value to fully close an opening degree of the EGR valve 83.

The processing flow may thereafter proceed to Step S04.

[Step S04: Acquisition of Intake Pressure Data]

After the EGR valve 83 receiving the instruction value of the opening degree operates until an actual opening degree becomes the opening degree based on the instruction value, that is, until the EGR valve 83 is fully closed, the ECU 100 may acquire data regarding history of the internal pressure of the intake manifold 57, i.e., intake pressure, detected by the intake pressure sensor 58 as data directed to diagnosis. The ECU 100 may thereafter hold the data in the unillustrated storage such as a RAM.

The processing flow may thereafter proceed to Step S05.

[Step S05: Determination as to Whether Acquisition of EGR Valve Diagnosis Data is Completed]

The ECU 100 may determine whether data on the intake pressure acquired in Step S04 have data volume enough to complete the diagnosis of EGR valve this time.

For example, in a case where acquisition of the data on the intake pressure is completed for all scheduled opening degree states, or in a case where abnormal determination is already reached on the basis of only data acquired in the middle, there may be no need to further acquire data on the intake pressure. For this reason, in such a case, the ECU 100 may determine that the acquisition of EGR valve diagnosis data is completed.

In a case where it is determined that the acquisition of the EGR valve diagnosis data is completed, the processing flow may proceed to Step S08. Otherwise, the processing flow may proceed to Step S06.

[Step S06: Determination as to Whether Satisfaction of EGR Valve Diagnosis Condition is Maintained]

The ECU 100 may determine whether the diagnosis start condition for the EGR valve, which has been determined to be satisfied in Step S01, continues to be satisfied.

In a case where it is determined that satisfaction of the diagnosis start condition for the EGR valve is maintained, the processing flow may proceed to Step S07 to continue the EGR valve diagnosis by the ECU 100.

In a case where it is determined that the diagnosis start condition for the EGR valve is not satisfied anymore, for example, in a case where the driver presses the accelerator pedal, etc., the processing flow may proceed to Step S08 to interrupt the EGR valve diagnosis performed by the ECU 100.

[Step S07: Increase of Opening Degree of EGR Valve]

The ECU 100 may provide the EGR valve 83 with an instruction value related to a new opening degree obtained by increasing a current opening degree by one step to increase the opening degree of the EGR valve 83.

The processing flow may thereafter return to Step S04, and repeat the similar processes.

[Step S08: Termination of EGR Valve Diagnosis]

The ECU 100 may terminate or complete or interrupt the EGR valve diagnosis.

In a case where the EGR valve diagnosis is completed and abnormity of the EGR valve is detected, the ECU 100 may output an error message to inform occupants including the driver of the abnormity of the EGR apparatus 80.

The processing flow may thereafter proceed to Step S09.

[Step S09: Restart of Fuel Injection]

The ECU 100 may provide the injector 39 with a valve opening signal to restart the fuel injection.

In this case, the ECU 100 may substantially set the second fuel injection amount based on pressure in the intake pipe, i.e., the internal pressure of the intake manifold 57, detected by the intake pressure sensor 58 as a target fuel injection amount. However, the ECU 100 may not use the first fuel injection amount based on the intake air amount detected by the air flow meter 54. The target fuel injection amount may form the basis to set, for example, a valve opening time or discharge pressure of an unillustrated high-pressure fuel pump, that is, fuel pressure.

In other words, a ratio between the first weight coefficient of the first fuel injection amount and the second weight coefficient of the second fuel injection amount, that is, a control sharing ratio between the fuel injection control based on the intake air amount and the fuel injection control based on the intake pressure, may become 0:100.

The processing flow may thereafter proceed to Step S10.

[Step S10: Start of Ignition Retard]

The ECU 100 may cause the engine 1 to start ignition retard. In the ignition retard, ignition timing to ignite fuel-air mixture by the spark plug 32 in each cylinder, which corresponds to an angular position of the crank shaft 10, may be delayed or lagged with respect to ignition timing during the normal driving.

During the usual driving, the ignition timing may be set to the vicinity of minimum advance for best torque (MBT) at which the maximum torque can be obtained. However, the pressure in the intake manifold 57 may become relatively greater with respect to the opening degree of the throttle valve 56 immediately after the EGR valve diagnosis is terminated. For this reason, an air amount introduced into the combustion chamber 31 may become greater. In a case where ignition by the spark plug 32 is carried out in the vicinity of the MBT in such a situation, excessive torque may be generated from the engine 1.

Therefore, in the example implementation, the ECU 100 may set a retard amount of the ignition timing in accordance with the internal pressure of the intake manifold 57 detected by the intake pressure sensor 58. This makes it possible to suppress generation of excessive torque immediately after restart of the fuel injection.

In one example, the retard amount of the ignition timing may be set upon start of retard so that current driver request torque set on the basis of an output of the accelerator pedal sensor 101 substantially matches actual output torque of the engine 1.

For example, the ECU 100 may set an initial retard amount by multiplying a predetermined coefficient by differential pressure. The differential pressure may be an excess of pressure by which actual internal pressure of the intake manifold 57 exceeds with respect to the internal pressure of the intake manifold 57 supposed or assumed from a current opening degree of the throttle valve 56 during the usual driving, that is, when the EGR valve 83 is set to a usual opening degree.

The processing flow then proceeds to Step S11.

[Step S11: Acquisition of Intake Pressure Data]

The ECU 100 may acquire data regarding current internal pressure of the intake manifold 57, i.e., intake pressure, detected by the intake pressure sensor 58, and hold the acquired data in the unillustrated storage such as a RAM.

The processing flow may thereafter proceed to Step S12.

[Step S12: Gradual Change of Weight Coefficients of Fuel Injection Amounts]

The ECU 100 may gradually vary the first and second weight coefficients in conjunction with lowering of the internal pressure of the intake manifold 57 so that the first weight coefficient of the first fuel injection amount is increased and the second weight coefficient of the second fuel injection amount is decreased.

For example, the ECU 100 may reduce the second weight coefficient of the second fuel injection amount in proportion to pressure reduction amount, i.e., differential pressure by which the current internal pressure of the intake manifold 57 drops with respect to the internal pressure of the intake manifold 57 upon restart of the fuel injection. Further, the ECU 100 may increase the first weight coefficient of the first fuel injection amount in proportion to the above-described differential pressure.

A gain in variation of the weight coefficient with respect to the differential pressure at this time may be set so that the second weight coefficient of the second fuel injection amount becomes substantially zero, that is, the control becomes the fuel injection control based on only the first fuel injection amount, when the internal pressure of the intake manifold 57 converges on internal pressure of the intake manifold 57 during the usual driving for the current opening degree of the throttle valve 56.

The processing flow may thereafter proceed to Step S13.

[Step S13: Decrease of Retard Amount of Ignition Timing]

The ECU 100 may gradually vary the ignition timing in conjunction with lowering of the internal pressure of the intake manifold 57 so that the retard amount of the ignition retard started at Step S10 is reduced, that is, the ignition timing is advanced.

For example, the ECU 100 may advance the ignition timing, i.e., reduce the retard amount, in proportion to pressure reduction amount, i.e., differential pressure between the internal pressure of the intake manifold 57 upon restart of the fuel injection and current pressure in the intake manifold 57 that is reduced from the foregoing internal pressure.

A gain in an advance quantity with respect to the differential pressure at this time may be set so that the retard amount becomes substantially zero, that is, ignition timing becomes the MBT, when the internal pressure of the intake manifold 57 converges on the internal pressure of the intake manifold 57 during the usual driving for the current opening degree of the throttle valve 56.

The processing flow may thereafter proceed to Step S14.

[Step S14: Determination of Intake Pressure]

The ECU 100 may determine whether the internal pressure of the intake manifold 57 detected by the intake pressure sensor 58 is equal to or lower than a determination value. This determination value may be set in advance by the ECU 100 in view of the internal pressure of the intake manifold 57 during the normal driving for the current opening degree of the throttle valve 56.

In a case where the ECU 100 determines that the internal pressure of the intake manifold 57 is equal to or less than the determination value, this may be considered that an influence on the internal pressure by the EGR valve diagnosis is substantially solved. For that reason, the processing flow may proceed to Step S15.

In contrast, in a case where the ECU 100 determines that the internal pressure of the intake manifold 57 exceeds the determination value, this may be considered that a state where the internal pressure is higher than that during the normal driving due to an influence of the EGR valve diagnosis continues. For that reason, the processing flow may return to Step S11, and the ECU 100 may repeat the processes in Steps S11 to S14.

[Step S15: Shift to Fuel Injection Control Based on Air Flow Meter]

The ECU 100 may set the second weight coefficient of the second fuel injection amount based on the internal pressure of the intake manifold 57 to substantially zero, thereby shifting to the fuel injection control in accordance with the first fuel injection amount based on the intake air amount detected by the air flow meter 54.

In other words, the ratio between the first weight coefficient of the first fuel injection amount and the second weight coefficient of the second fuel injection amount, that is, the control sharing ratio between the fuel injection control based on the intake air amount and the fuel injection control based on the intake pressure, may become 100:0.

The processing flow may thereafter proceed to Step S16.

[Step S16: Termination of Ignition Retard]

The ECU 100 may terminate the retard of the ignition timing, and shift to a usual ignition timing control in which the ignition timing substantially matches the MBT.

The ECU 100 may thereafter terminate a series of processes, and shift to a usual engine control.

Figure 3:
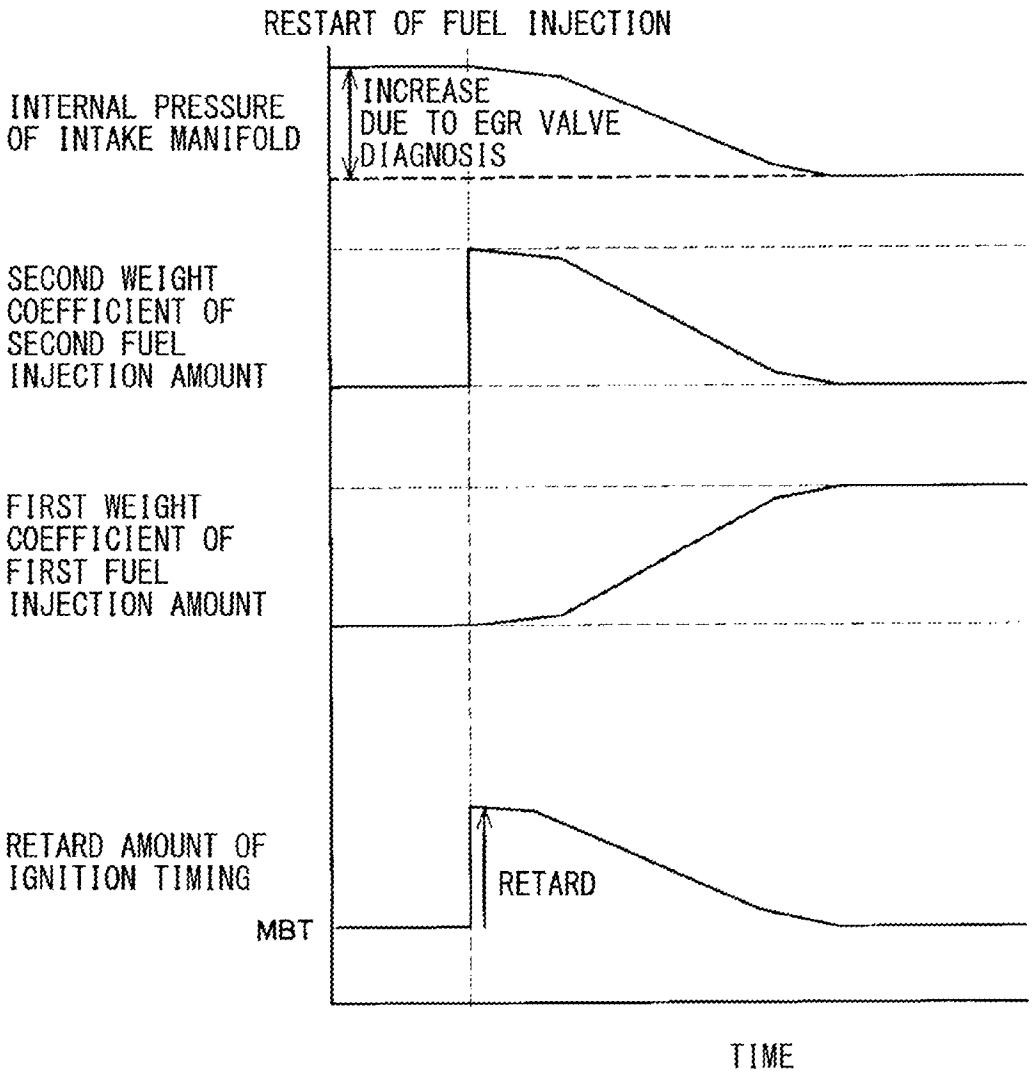
FIG. 3 is a timing chart illustrating an example of transition of each parameter after the EGR valve diagnosis carried out by the engine control apparatus illustrated in FIG. 1.

FIG. 3 is a timing chart illustrating transition of each parameter after the EGR valve diagnosis carried out by the engine control apparatus illustrated in FIG. 1.

In FIG. 3, a horizontal axis indicates time, and a vertical axis indicates the internal pressure of the intake manifold 57, the second weight coefficient of the second fuel injection amount, the first weight coefficient of the first fuel injection amount, and the retard amount of ignition timing. In FIG. 3, retard is indicated as an upper direction.

In the example implementation, as described above, the variation in the weight coefficient of each fuel injection amount and reduction of the retard amount of the ignition timing may be carried out in proportion to reduction of the internal pressure of the intake manifold 57. Herewith, a waveform indicating transition of each of these parameters may have a shape similar to that of a waveform indicating transition of the internal pressure of the intake manifold 57.

According to the engine control apparatus and the engine control system of the example implementation described above, it is possible to obtain the following example effects.

(1) In a case where the diagnosis of the EGR valve 83 is terminated or interrupted, the opening degree of the EGR valve 83 may become greater than that during the usual driving, and air with relatively-high pressure may be stored inside the intake manifold 57. In such a state, a correlation between the intake air amount detected by the air flow meter 54 and the air amount introduced into the combustion chamber 31, that is, each cylinder, becomes smaller. In the example implementation, the engine control apparatus may carry out the fuel injection control based on the second fuel injection amount, which is calculated on the basis of the internal pressure of the intake manifold 57, immediately after restart of the fuel injection after the EGR valve diagnosis has been carried out. In other words, the engine control apparatus may increase the second weight coefficient of the second fuel injection amount in such a situation. This makes it possible to carry out appropriate fuel injection with respect to the air amount actually introduced into the combustion chamber 31. Therefore, it is possible to prevent output torque of the engine 1 from suddenly varying due to an excessively-lean or excessively-rich air-fuel ratio. It is also possible to prevent engine stall from occurring due to misfire.

Further, by maintaining the air-fuel ratio in the vicinity of stoichiometric, that is, a theoretical air-fuel ratio, it is also possible to suppress deterioration of a property of the exhaust gas.

Moreover, in the example implementation, the engine control apparatus may gradually vary the first and second weight coefficients after restart of the fuel injection so that the first weight coefficient of the first fuel injection amount based on the intake air amount detected by the air flow meter 54 is increased and the second weight coefficient of the second fuel injection amount is decreased. This makes it possible to gently shift to the fuel injection control using the air flow meter 54, which is typically used during the usual driving of the engine 1, after the EGR valve diagnosis.

(2) In the example implementation, the engine control apparatus may vary the first weight coefficient of the first fuel injection amount and the second weight coefficient of the second fuel injection amount in proportion to the reduction of the internal pressure of the intake manifold 57. This makes it possible to appropriately set a variation rate at which each of the first and second weight coefficients is gradually varied. It is therefore possible to shift to a control during the usual driving more smoothly.

(3) In the example implementation, the engine control apparatus may retard the ignition timing in accordance with the internal pressure of the intake manifold 57 immediately after restart of the fuel injection after the EGR valve diagnosis has been carried out. Therefore, it is possible to suppress excessive torque from occurring due to introduction, into the combustion chamber 31, of large quantity of air stored in the intake pipe. It is also possible to prevent shock from occurring on the vehicle body. This makes it possible to secure drivability and comfort of the vehicle on which the engine control apparatus according to the example implementation is mounted.

(4) In the example implementation, the engine control apparatus may gradually reduce the retard amount of the ignition timing after restart of the fuel injection in proportion to reduction of the internal pressure of the intake manifold 57. Therefore, it is possible to appropriately set a variation rate of the retard amount immediately after restart of the fuel injection. It is therefore possible to gently vary the output torque of the engine 1. This makes it possible to cause the ignition timing of the spark plug 32 to shift more smoothly to the ignition timing during the usual driving.

According to one implementation of the technology, it is possible to provide an engine control apparatus and an engine control system each capable of suppressing sudden variation in torque at a time when fuel injection is restarted after diagnosis of an EGR apparatus is terminated.

MODIFICATION EXAMPLES

Although some implementations of the technology have been described in the foregoing by way of example with reference to the accompanying drawings, the technology is by no means limited to the implementations described above. It should be appreciated that modifications and alterations may be made by persons skilled in the art without departing from the scope as defined by the appended claims. The technology is intended to include such modifications and alterations in so far as they fall within the scope of the appended claims or the equivalents thereof.

(1) The configurations of the engine control apparatus and the engine 1 are not limited to those of the example implementation described above, and can be modified appropriately.

For example, any of a cylinder layout of the engine 1, the number of cylinders of the engine 1, a fuel injection system of the engine 1, presence or absence of a supercharger of the engine 1, etc. can be modified appropriately.

Further, the engine 1 according to the example implementation described above is a gasoline engine as one example. However, the technology is not limited to this type, and can also be applied to any other spark-ignition type engine using another fuel.

(2) In the example implementation described above, the engine control apparatus may gradually vary the second weight coefficient of the second fuel injection amount based on the pressure in the intake pipe, that is, the internal pressure of the intake manifold 57, and the first weight coefficient of the first fuel injection amount based on the intake air amount detected by the air flow meter 54 so as to have a waveform similar to that of the lowering of the pressure in the intake pipe. However, a method of gradually varying each of the first and second weight coefficients is not limited to this, and can be modified appropriately.

For example, the engine control apparatus may detect a decrease rate of the pressure in the intake pipe and linearly vary each of the first and second weight coefficients with a variation ratio that is set in accordance with this decrease rate.

(3) In the example implementation described above, the engine control apparatus may gradually vary the retard amount of the ignition timing so as to have a waveform similar to that of the lowering of the pressure in the intake pipe. However, a method of gradually varying the retard amount is not limited to this, and can be modified appropriately.

For example, the engine control apparatus may detect the decrease rate of the pressure in the intake pipe and linearly reduce the retard amount with a variation ratio that is set in accordance with this decrease rate.

(4) In the example implementation described above, the engine control apparatus may carry out the fuel injection control substantially on the basis of only the second fuel injection amount immediately after restart of the fuel injection after the EGR valve diagnosis has been carried out. However, the fuel injection control immediately after restart of the fuel injection is not limited to this. For example, the engine control apparatus may carry out the fuel injection control on the basis of the first and second fuel injection amounts immediately after restart of the fuel injection by using the first fuel injection amount multiplied by a relatively-small first weight coefficient in conjunction with the second fuel injection amount.

The ECU 100 illustrated in FIG. 1 is implementable by circuitry including at least one semiconductor integrated circuit such as at least one processor (e.g., a central processing unit (CPU)), at least one application specific integrated circuit (ASIC), and/or at least one field programmable gate array (FPGA). At least one processor is configurable, by reading instructions from at least one machine readable non-transitory tangible medium, to perform all or a part of functions of the ECU 100. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and a SRAM, and the nonvolatile memory may include a ROM and a NVRAM. The ASIC is an integrated circuit (IC) customized to perform, and the FPGA is an integrated circuit designed to be configured after manufacturing in order to perform, all or a part of the functions of the ECU 100 illustrated in FIG. 1.

The invention claimed is:

1. An engine control apparatus comprising:

a memory;

a processor coupled with the memory, the processor configured to:

calculate a first fuel injection amount on a basis of an intake air amount detected by an air flow meter;

calculate a second fuel injection amount on a basis of pressure in an intake pipe detected by an intake pressure sensor;

control a fuel injection apparatus for an engine on a basis of a correction fuel injection amount, the correction fuel injection amount being a result of addition of the first fuel injection amount multiplied by a first weight coefficient and the second fuel injection amount multiplied by a second weight coefficient;

control an EGR valve, the EGR valve being configured to open and close an EGR flow passage through which exhaust gas from the engine is introduced to the intake pipe; and carry out diagnosis of the EGR valve on a basis of the pressure in the intake pipe at a time when an opening degree of the EGR valve is varied in a state where an injector included in the fuel injection apparatus stops injecting fuel into a combustion chamber of the engine, wherein the processor is configured to increase, when the injector restarts injecting fuel into the combustion chamber after the diagnosis of the EGR valve is carried out the second weight coefficient, and to gradually vary, after the increasing of the second weight coefficient, the first and second weight coefficients to cause the second weight coefficient to be reduced and the first weight coefficient to be increased.

2. The engine control apparatus according to claim 1, wherein the processor is configured to gradually vary the second weight coefficient and the first weight coefficient in conjunction with a variation of the pressure in the intake pipe.

3. The engine control apparatus according to claim 2, wherein the processor is configured to set ignition timing for the engine, wherein the processor is configured to delay, when the fuel injection is restarted after the diagnosis of the EGR valve is carried out the ignition timing by a retard amount with respect to the ignition timing at a usual time, the retard amount being set on a basis of the pressure in the intake pipe detected by the intake pressure sensor.

4. The engine control apparatus according to claim 3, wherein the processor is configured to gradually decrease the retard amount in conjunction with the variation of the pressure in the intake pipe.

5. The engine control apparatus according to claim 1, wherein the processor is configured to set ignition timing for the engine, and wherein the processor is configured to delay, when the fuel injection is restarted after the diagnosis of the EGR valve is carried out the ignition timing by a retard amount with respect to the ignition timing at a usual time, the retard amount being set on a basis of the pressure in the intake pipe detected by the intake pressure sensor.

6. The engine control apparatus according to claim 5, wherein the processor is configured to gradually decrease the retard amount in conjunction with a variation of the pressure in the intake pipe.

7. An engine control apparatus comprising:

circuitry configured to control an engine and an EGR apparatus, the circuitry being configured to:

calculate a first fuel injection amount on a basis of an intake air amount detected by an air flow meter, calculate a second fuel injection amount on a basis of pressure in an intake pipe detected by an intake pressure sensor, control a fuel injection apparatus for the engine on a basis of a correction fuel injection amount, the correction fuel injection amount being a result of addition of the first fuel injection amount multiplied by a first weight coefficient and the second fuel injection amount multiplied by a second weight coefficient, control an EGR valve configured to open and close an EGR flow passage, in the EGR apparatus, through which exhaust gas from the engine is introduced to the intake pipe, carry out diagnosis of the EGR valve on a basis of the pressure in the intake pipe at a time when an opening degree of the EGR valve is varied in a state where an injector included in the fuel injection apparatus stops injecting fuel into a combustion chamber of the engine, and increase, when the injector restarts injecting fuel into the combustion chamber after the diagnosis of the EGR valve is carried out, the second weight coefficient, and to gradually vary, after the increasing of the second weight coefficient, the first and second weight coefficients to cause the second weight coefficient to be reduced and the first weight coefficient to be increased.

* * * * *